United States Patent [19]

Suzuki et al.

[11] Patent Number: 4,738,889

[45] Date of Patent: Apr. 19, 1988

[54] HEAT TRANSFER SHEET

[75] Inventors: Takeo Suzuki; Hideichiro Takeda; Kyoichi Yamamoto, all of Tokyo, Japan

[73] Assignee: Dai Nippon Insatsu Kabushiki Kaisha, Japan

[21] Appl. No.: 923,386

[22] Filed: Oct. 27, 1986

[30] Foreign Application Priority Data

Oct. 28, 1985 [JP] Japan ..... 60-241009

[51] Int. Cl.[4] ..... B41M 5/26

[52] U.S. Cl. ..... 428/195; 106/23; 106/25; 106/27; 106/31; 106/32; 428/212; 428/484; 428/488.4; 428/913; 428/914

[58] Field of Search ..... 106/31, 25, 23, 27, 106/32; 428/195, 212, 411.1, 484, 488.1, 488.4, 913, 914

[56] References Cited

U.S. PATENT DOCUMENTS 3,873,590 3/1972 Straus et al. ..... 252/549
3,875,102 4/1975 Straus et al. ..... 524/157

*Primary Examiner*—Bruce H. Hess
*Attorney, Agent, or Firm*—Parkhurst & Oliff

[57] ABSTRACT

A heat transfer sheet comprises a sheet for heat transfer recording which transfers ink on a base sheet onto a recording paper, said ink containing a compound represented by formula (I) shown below as a binder component:

$$C_nH_{2n+1}CH_2Y \quad (I)$$

wherein n is an integer of 21 to 50, and Y represents OH, $SO_3H$, $C_6H_5$ or COOH, or a Ca, Al or Zn salt thereof.

15 Claims, 1 Drawing Sheet

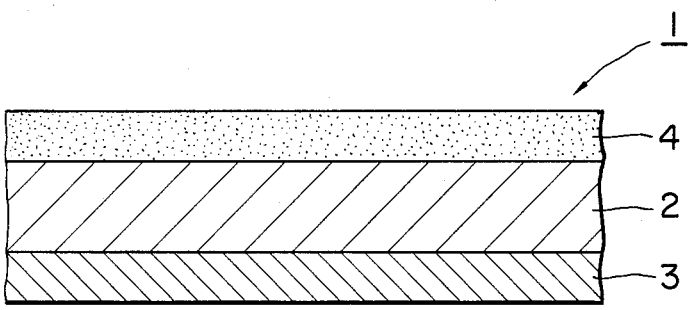
1
4
2
3

HEAT TRANSFER SHEET

BACKGROUND OF THE INVENTION

This invention relates to heat transfer sheets and, more particularly, to a heat transfer sheet suitable for heat transfer recording by use of a printing means such as a thermal head by short-time, high-temperature heating.

As the heat transfer sheet for performing heat transfer recording in printers for computers, word processors, and facsimiles, a material comprising an ink meltable by heating applied as coating on a base sheet such as polyester film has been used heretofore. As such hot-melt ink, a mixture comprising a colorant such as carbon black, a pigment or a dye kneaded with a binder has been used.

Of the components formulated in such hot-melt ink, particularly the binder is an important component because of its great influence on various characteristics required for a heat transfer sheet such as transfer characteristic of ink and storability.

In the prior art, as such binder component, waxes or higher fatty acids have been used. More specifically, waxes such as paraffin wax, microcrystalline wax, polyethylene wax, beeswax, white wax, carunauba wax, montan wax, ceresin wax, and castor wax, stearic acid and derivatives thereof such as stearic acid, stearic acid amide, and stearic acid metal salts, and higher fatty acid amides have been employed.

However, a hot-melt ink produced by use of a binder as mentioned above involves the following problems.

(a) Generally speaking, as the characteristics required for hot-melt ink for use in heat transfer sheet, sensitivity, resolution, storability, coated film hardness, pigment dispersibility, and coating suitability may be mentioned as the main ones. In the binders of the prior art as described above, some are effective in improving several characteristics of those as mentioned above, but the above binders are not necessarily sufficiently satisfactory for improving all of the above characteristics with good balance. In other words, in the binders of the prior art as described above, there is a great tendency of the above characteristics mutually cancelling each other.

(b) In connection with the coating suitability as mentioned above, it has been difficult to use the hot-melt ink of the prior art in such a manner that two or more kinds of ink, for example, same color inks with different colors are applied as coating separately or superposed on one another on the same base sheet. The reason for this is that, when an attempt is made to apply the hot-melt ink, the ink previously coated will be melted by the heat.

For avoiding this problem, there have been attempts to use a wax emulsion or a non-aqueous system wax emulsion or to employ a special coating method, but difficulties are encountered such as poor storability of the product or low workability in coating. Thus, no practical level has been reached.

A similar problem also occurs, other than in the hot-melt ink, in the case of applying as coating an OP (over printing) layer for prevention of the so-called ground staining or for improvement of abrasion resistance.

SUMMARY OF THE INVENTION

The present invention has been accomplished for solving the problems accompanying the prior art as described above and is intended to provide:

(a) a heat transfer sheet of excellent sensitivity, resolution, storability, coated film hardness, pigment dispersibility and coating suitability; and (b) a heat transfer sheet by use of a hot-melt ink which can be easily applied as coatings separately as inks with different colors or superposed on one another and is also convenient for formation of an OP layer.

In order to accomplish the above objects of the present invention, the heat transfer sheet according to the present invention is a sheet for heat transfer recording which transfers by heating and melting ink on a base sheet onto a recording paper, this ink containing a compound represented by the formula (I) shown below as a binder component:

$$C_nH_{2n+1}CH_2Y \qquad (I)$$

wherein n is an integer of 21 to 50, and Y represents OH, $SO_3H$, $C_6H_5$ or COOH, or Ca, Al or Zn salt thereof.

Further, in the heat transfer sheet of the present invention, as the binder component, the compound represented by the formula (II) shown below can be further contained in addition to the compound of the above formula (I):

$$R-\underset{\underset{O}{\|}}{C}-O-CHY-O-\underset{\underset{O}{\|}}{C}-R' \qquad (II)$$

wherein R and R', which may be either identical or different, each represents an alkyl group having 28 to 34 carbon atoms, and Y is the same as defined above.

BRIEF DESCRIPTION OF THE DRAWING

In the accompanying drawing, the single FIGURE is a sectional view of a heat transfer sheet according to the present invention.

DETAILED DESCRIPTION OF THE INVENTION

In a preferred embodiment of the present invention, as shown in the drawing, the heat transfer sheet 1 according to the present invention comprises an ink layer 3 provided on the surface of a base sheet 2. Further, in a preferred embodiment of the present invention, an antisticking layer 4 may be provided on the surface of the base sheet 2 on the side where no ink layer 3 is provided (namely, the side to be contacted by a thermal head). The antisticking layer 4 is a layer for imparting slip property by preventing fusion between the thermal head and the base sheet during printing.

Further, in the present invention, although not shown in the drawing, an OP layer (over printing layer) can be provided between the base sheet 2 and the ink layer 3 or on the surface of the ink layer for the purpose of improving abrasion resistance and preventing ground staining.

In the following, the respective constituent materials of the heat transfer sheet of the present invention are described in detail.

BASE SHEET

A conventional base sheet can be used as it is as a base sheet in the present invention. Other sheets can be also used. The base sheet of the present invention is not particularly limited. Examples of the base sheet materials include plastics such as polyester, polypropylene, cellophane, polycarbonate, cellulose acetate, polyethylene, polyvinyl chloride, polystyrene, nylon, polyimide, polyvinylidene chloride, polyvinyl alcohol, fluorine resins, rubber hydrochloride, and ionomers; papers such as capacitor paper, and paraffin paper; and nonwoven fabrics. Composite sheet thereof may be also used.

The thickness of this base sheet can suitably vary depending upon materials in order to obtain appropriate strength and thermal conductivity. The thickness of the base sheet is, for example, from 1 to 25 μm, preferably from 3 to 25 μm.

INK LAYER

A hot melt ink layer suitable for use in the present invention comprises a coloring agent and a binder, and may contain various additives as needed.

The coloring agents include organic and inorganic pigments and dyes. Preferred of these are pigments and dyes having good characteristics as recording materials, for example, those pigments and dyes having a sufficient color density and exhibiting no discoloration or fading under conditions such as light, heat and humidity.

The coloring agents may be materials which are colorless when they are not heated but form colors upon being heated. The coloring materials may be materials which form colors upon contacting a material contained in a transferable sheet. In addition to the coloring agents which form cyan, magenta, yellow and black, coloring agents having other various colors can be used. That is, the hot-melt ink composition contains, as coloring agents, carbon black or various dyes or pigments selected according to the color which is to be imparted to the ink composition.

A point which is particularly important in the heat transfer sheet of the present invention is that a compound of the formula (I) shown below is contained as the binder component of ink:

$$C_nH_{2n+1}CH_2Y \qquad (I)$$

wherein n is an integer of 21 to 50 and Y represents OH, $SO_3H$, $C_6H_5$ or COOH, or Ca, Al or Zn salt thereof.

Particularly preferred as the compound of the above formula (I) are higher alcohols of Y=OH formed by oxidation and reduction of paraffins, which are compounds having molecular weights within the range of from 750 to 900 and derivatives thereof. Particularly, higher alcohols obtained from paraffins of n=26~40 are preferably employed. Examples of n-paraffins to be used as the starting material for these higher alcohols are heneicosane, docosane, tricosane, tetracosane, pentacosane, hexacosane, heptacosane, octacosane, nonacosane, triacontane, hentriacontane, dotriacontane, tritriacontane, pentatriacontane, hexatriacontane, tetracontane, dotetracontane, pentacontane and the like.

The most preferable example is 14, 21, 28, 35-tetramethyl-1-hydroxy-pentacontane (m.p. 92° C.). In some cases, by use of this compound as the main component, the melting point can be controlled by mixing with this compound homologues such as 7,14,21-trimethyl-1-hydroxyhentriacontane (m.p. 68° C.) or 7,21-dimethyl-hydroxytetracontane (m.p. 81° C.) in amounts within 20 wt.%.

As a compound of the above formula (I), a chain sulfonic acid of $Y=SO_3H$, a chain carboxylic acid of Y=COOH, a compound of $Y=C_6H_5$ or metal salts of these can be used.

The content of the above compound (I) in the ink composition is preferably 10 to 98 wt.%, more preferably 40 to 80 wt.%.

As the binder component, in addition to the above compound (I), a compound represented by the formula shown below may be also contained:

$$R-\underset{\underset{O}{\|}}{C}-O-CHY-O-\underset{\underset{O}{\|}}{C}-R' \qquad (II)$$

wherein R and R', which may be either identical or different, each represents an alkyl group having 28 to 34 carbon atoms, and Y is the same as defined above.

The compound of the formula (II) is an ester obtained by the reaction between a fatty acid and a polyhydric alcohol, and its formulation is significant particularly in that the pigment dispersibility is excellent, and the hardness of the ink layer coated can be controlled.

As such a compound (II), it is possible to use an ester obtained by the reaction between a fatty acid such as butyric acid, valeric acid, caproic acid, caprylic acid, capric acid, lauric acid, myristic acid, palmitic acid, stearic acid, linoleic acid, hiragoic acid, linolenic acid, ricinoleic acid, oleic acid or the like and a polyhydric alcohol such as glycerine, erythritol, pentaerythritol, arabitol, sorbitol, sorbitane, mannitol, trimethylolpropane, glycols or the like.

Particularly, as the compound (II), an ester obtained by the reaction between a soybean fatty acid such as linoleic acid, oleic acid, linolenic acid, palmitic acid or the like and a polyhydric alcohol comprising a mixture of trimethylolpropane and glycerine (e.g., a formulation mixed at a ratio of 6:4), having an ester value of 70 to 90 and a molecular weight of 300 to 900 is preferably used. More specifically, glycidyl dioctacontanate is preferably employed.

When the compound (II) is contained, in the binder component, the compound (II) should be preferably formulated at a formulation ratio of 10 to 100 parts by weight of the compound (II) per 10 to 100 parts by weight of the compound (I), and in an amount of the compound (II) not more than that of the compound (I).

By the use of the binder component as described above, various characteristics required for the heat transfer sheet can be improved with good balance.

Next, these various characteristics are described.

First, resolution means the degree of reproducibility of the image corresponding to the shape and the number of the dots of the thermal head. Generally speaking, the density of transferred dot will be increased as the dot density (dot number per unit area) is increased, but the heat generated dot density of the thermal head is not proportional to the transferred dot density if the resolution is small. Resolution becomes better as the deviation between the theroetical proportional relationship and the proportional relationship in practical printing becomes smaller.

Sensitivity, in this case, means the magnitude of the energy applied on the thermal head which is required for maintaining good resolution. Sensitivity becomes better as the applied energy becomes smaller. Generally, sensitivity can be improved as the melting point of the ink is made lower, but on the other hand lowering of the melting point will result in worsening of storability. To describe in more detail, a heat transfer sheet is used ordinarily in a wound-up state and, in such a form, the ink layer and the base sheet contact each other, whereby both may be fused together or the ink may be transferred onto the base sheet by the influence of the environmental temperature. Thus, sensitivity and storability will cancel each other.

Pigment dispersibility refers to readiness of a coloring agent to be dispersed into a binder. Ordinarily, a binder and a coloring agent are mixed, dispersed and kneaded by means of a device such as an attritor, ball mill, or sand mill. In this case, pigment dispersibility is better as the time before the coloring agent becomes a certain particle size or smaller becomes shorter, the wettability between binder and colorant and flowability become better, and sedimentation or reagglomeration of the pigment after dispersing and kneading becomes less.

Coated film hardness means durability of the transferred image.

Coating suitability refers to readiness in formation when an ink layer is being formed on the substrate sheet surface. It is generally determined by the wettability between the base sheet and the ink.

For the binders of the prior art, the various characteristics as described above were examined to obtain the results shown below in Table 1.

TABLE I

| Binder | Sensitivity | Resolution | Storability | Coated film hardness | Pigment dispersibility | Coating suitability |
|---|---|---|---|---|---|---|
| Paraffin wax (1) | O | O | X | X | X | O |
| Paraffin wax (2) | Δ | Δ | Δ | Δ | X | O |
| Paraffin wax (3) | X | X | O | O | X | X |
| Microcrystalline wax | O | Δ | Δ | Δ | Δ | Δ |
| Polyethylene wax | X | X | O | O | Δ | X |
| Beeswax | O | Δ | X | X | Δ | Δ |
| White wax | O | Δ | X | X | X | X |
| Carunauba wax | X | O | O | O | O | X |
| Montan wax | O | X | X | X | O | O |
| Oresin wax | O | Δ | Δ | Δ | X | Δ |
| Castor wax | Δ | O | X | O | O | O |
| Stearic acid | O | X | X | X | O | O |
| Stearic acid amide | Δ | X | X | O | O | O |
| Stearyl alcohol | Δ | Δ | Δ | X | X | X |

(In the above Table, the respective symbols mean the following: O : good, Δ: slightly good, X: low)

As is apparent from Table-I, in the binders of the prior art, it is difficult to obtain all of excellent characteristics.

In contrast, in the binder of the present invention, improved effects can be seen in all of the above characteristics, as shown in the following Table-II.

TABLE II

| Binder | Sensitivity | Resolution | Storability | Coated film hardness | Pigment dispersibility | Coating suitability | Overall evaluation |
|---|---|---|---|---|---|---|---|
| Compound (I) | O | O | O | Δ | Δ | O | O |
| (I)/(II)* = 9/1 | O | O | O | O | O | O | ◎ |
| (I)/(II) = 8/2 | O | O | O | O | O | O | ◎ |
| (I)/(II) = 6/4 | O | O | O | O | O | O | ◎ |
| (I)/(II) = 5/5 | O | O | O | O | O | O | ◎ |
| (I)/(II) = 4/6 | Δ | O | O | O | O | O | O |
| (I)/(II) = 2/8 | Δ | Δ | O | O | ◎ | O | O |
| Compound (II) | Δ | Δ | O | O | ◎ | O | O |

(In the above Table, the respective symbols mean the following: *formulation ratio of Compound (I) to Compound (II), ◎: extremely good, O : good, Δ: slightly good)

The ink can be prepared, for example, as follows.

First, a coloring agent is dispersed in and kneaded with a varnish having a small amount of a thermoplastic resin dissolved in a solvent. Suitable examples of the thermoplastic resin are low molecular weight polyethylene, polyvinyl acetate, ethylene-vinyl acetate copolymer, ethylene-ethyl acrylate copolymer, ethylene-ethyl acrylate-maleic acid terpolymer, polyisobutylene, and polybutene. Examples of the solvent are toluene, xylene, MIBK, ethylcyclohexanone, and cyclohexane. The dispersion having a coloring agent dispersed in a varnish is heated to 50° to 60° C., and the compound of the above formula (I), or the compound of the formula (I) and the compound of the formula (II) are added to form an ink. Rosin ester, fatty acid amide, carunauba wax, candellila wax, etc. may be also added thereto in appropriate amounts.

As optional components, there may be included, for example, pliability imparting agents such as mineral or vegetable oils, thermal conductivity enhancers such as metallic powder, extender pigments such as calcium carbonate or kaolin, and transferability enhancers such as polyhydric alcohols.

The ink is in the state of a soft gel at room temperature and can be placed in a fluid state by heating it to 30° to 50° C. before its application as a coating on a base sheet.

Specifically, coating of one surface of a base sheet may be practiced according to a procedure in which the composition is applied as a coating while being heated and melted such as hot melt coating, a conventional coating procedure such as gravure coating, roll coating, air knife coating, kiss coating, spray coating, dressing flow coating, dip coating, spinner coating, wheeler coating, brush coating, solid coating with silk screen, wire bar coating, and flow coating, or alternatively a printing system such as gravure printing, gravure off-set printing, flat plate off-set printing, die lithographic printing, concave plate printing, and silk screen printing.

The thickness of the ink layer provided as described above is 0.1 μm to 1,000 μm, preferably 1 μm to 100 μm. With a thickness less than 0.1 μm, the density of the printed letter cannot be increased to be useless in recording, while transfer cannot be satisfactorily accomplished due to poor thermal conductivity if the thickness exceeds 1,000 μm.

An aqueous system or non-aqueous solvent system dispersion can be also utilized as the ink. Its preparation and use is possible by following the above description and the known techniques of the prior art.

A hot-melt ink in which the compound of the above formula (I) or the compound of the formula (I) and the compound of the formula (II) is blended has a sharp melting point and can be quickly melted at a relatively low temperature to be transferred. Accordingly, by the use of the heat transfer sheet of the present invention, high-speed printing can be carried out sharply.

By selecting and combining appropriately the kind of the compound (I) or (I)+(II), color inks with different melting points can be obtained, and they can be applied as coating separately on one supporting member by applicating, for example, successively from the ink with higher melting point to the ink with lower melting point without mixing of the colors at the boundary, as a matter of course, but they can also applied in superposed state on one another.

The heat transfer sheet of the present invention, which uses an ink blended with the binder as described above, can be desolventized well during preparation and also has the benefit of good dispersing color forming characteristic of the pigment. It also has good storage stability without occurrence of rancid aging or blooming. Also, when used, the melting-solidifying speed is rapid to afford high-speed printing. Further, its coating suitability is high, and the printed letter has high resolution and sharpness.

Modified Example

Formation of OP layer:

In the present invention, abrasion resistance of the printed image can be improved by providing an over printing layer (OP layer) between the base sheet and the ink layer. Also, by providing OP layer on the surface of the ink layer, the effect of preventing ground staining can be obtained.

Such an OP layer may be formed by dispersing 1 to 10 wt.% of a fine particulate substance selected from those shown below in the above compound (I) or a mixture of the above compound (I) and the compound (II):

PMMA fine powder (e.g., "MP 1000" produced by Soken Kagaku, Japan, 0.3μ);

Benzoguanamine fine powder (e.g., "Eposter S" produced by Nippon Shokubai, Japan, 0.3μ);

PTFE fine powder (e.g., "Fruone L169J" produced by Asahi Glass, Japan, 0.2μ);

Magnesium silicate fine powder (e.g., "Microace L-1" produced by Nippon Talc, Japan).

When improvement of abrasion resistance is intended, the above OP layer is formed first on the base sheet by application thereof in an amount of 0.2 to 3 g/m$^2$, followed by provision of an ink layer thereon. After heat transfer, the OP layer protects the surface of the printed letter.

When the provision of a staining preventive OP is intended, the ink layer provided on the base sheet is coated with an ink of the above formulation in an amount of 0.2 to 2 g/m$^2$. In place of the ink, a carunauba wax emulsion may be also employed. Staining preventive OP is also beneficial for improvement of storability of the heat transfer sheet and resolution of the printed letter, in addition to prevention of ground staining.

Antisticking layer:

If the material from which a base sheet is produced has a low degree of heat tolerance, it is preferable that the thermal head-contacting surface be provided with a layer for preventing sticking to the thermal head since high energy and heat are transmitted by the thermal head when printing is carried out under a low temperature atmosphere or at a high speed. The following compositions can be used for preparing the antisticking layer.

(a) Compositions containing (i) a thermoplastic resin having an OH or COOH group, such as acrylpolyol, urethane having an OH group, and vinylchloridevinylacetate copolymer, polyesterpolyol, (ii) a compound having at least 2 amino groups, diisocyanate or triisocyanate, (iii) a thermoplastic resin, and (iv) a material which acts as a heat releasing agent or lubricant.

(b) Compositions containing (i) a resin such as silicone-modified acrylic resin, silicone-modified polyester resin, acrylic resin, polyester resin, vinylidene fluoride resin, vinylidene fluoride-ethylene tetrafluoride copolymer resin, polyvinyl fluoride resin, and acrylonitrile-styrene copolymer resin, and (ii) a heat releasing agent or lubricant. Examples of the heat releasing agents or lubricants are materials which melt on heating to exhibit their action such as for example waxes and amides, esters or salts of higher fatty acids, and materials which are useful in the form of solid per se, such as for example fluorine resins and inorganic material powders.

The provision of such an antisticking layer makes it possible to carrry out thermal printing without occurrence of sticking even in a heat transfer sheet wherein a heat unstable plastic film is used as a substrate. The merits of plastic films such as good resistance to cutting and good processability can be put to practical use.

Matte layer or matte processed:

While heat transfer generally provides glossy and beautiful printing, it is difficult to read the printed documents in some cases. Accordingly, matte printing may be desirable. In this case, a heat transfer sheet which provides matte printing can be produced by applying as coating a dispersion of inorganic pigments such as silica and calcium carbonate in a resin dissolved in a suitable solvent, onto a base sheet to form a matte layer, and applying as coating a hot melt ink composition onto the matte layer. Alternatively, a base sheet per se may be matte processed and used.

Antistatic agents:

In order to overcome drawbacks due to static electricity, it is recommended that at least one layer of the heat transfer sheet contain an antistatic agent. The antistatic agent can be incorporated into any of the base sheets, the ink layer, and the antisticking layer. Particularly, it is preferable that the antistatic agent be incorporated into the antisticking layer.

Antistatic agents used in the present invention include any known antistatic agent. Examples of antistatic agents include a vartiety of surfactant-type antistatic agents such as various cationic antistatic agents having cationic groups such as quaternary ammonium salt, pyridinium salt and primary, secondary or tertiary amino groups; anionic antistatic agents having anionic groups such as sulfonate, sulfate, phosphate and phosphonate; amphoteric antistatic agents of amino acid type, aminosulfate type or the like; and nonionic antistatic agents of amino-alcohol type, glycerin type, polyethylene glycol type or the like. Further antistatic agents include polymeric antistatic agents obtained by polymerizing the antistatic agents as described above. Other antistatic agents which can be used include polymerizable antistatic agents such as radiation polymerizable monomers and oligomers having tertiary amino or quaternary ammonium groups, such as N,N-dialkylaminoalkyl(meth)acrylate monomers and quaternarized products thereof.

Particularly, the use of such polymerizable antistatic agents can provide stable antistatic properties for a long period of time because these antistatic agents integrate with the formed resin layer.

In order to indicate more fully the nature and utility of this invention, the following examples are set forth, it being understood that these examples are presented as illustrative only and are not intended to limit the scope of the invention. All parts used herein are by weight unless otherwise specified.

EXAMPLE 1

According to the following formulation, an ink for heat transfer recording was prepared.

| | |
|---|---|
| Compound of formula (I): 14,21,28,35-tetramethyl-1-sulfonil-pentacontane (molecular weight 840, m.p. 72° C.) | 32 parts |
| Ethylene-vinyl acetate copolymer "Evaflex 310" (Mitsui Polychemical, Japan) | 3 |
| Carbon black (Tokai Denkyoku, Japan) | 5 |
| Xylene | 60 |
| | 100 |

The above ink was applied to a thickness of 3.0μ on a polyester film with a thickness of 3.5μ to produce a heat transfer sheet.

When the sheet was used by mounting it on a thermal printer, sharp printed letters were obtained.

EXAMPLE 2

According to the following formulation, a yellow ink for heat transfer recording was prepared.

| | |
|---|---|
| Compound of formula (I): 14,21,28,35-tetramethyl-1-hydroxy-pentacontane (50 parts) and 7,14,21-trimethyl-1-hydroxy-hentriacontane (50 parts) (molecular weight 650, m.p. 63° C.) | 32 parts |
| Low molecular weight polyethylene "AC 400A" (Nippon Unicar, Japan) | 3 |
| CI No. 15850 Carmine 6B | 5 |
| Xylene | 60 |
| | 100 |

A heat transfer sheet was prepared in the same manner as in Example 1, and used for printing by a thermal printer. As a result, sharp printed letters were similarly obtained.

EXAMPLE 3

In Example 1, in place of carbon black, yellow, magenta, and cyan coloring agents were used to prepare inks of the three primary colors, respectively.

These color inks were applied separately on a polyester film with a thickness of 3.5μ by the use of a gravure printing plate with a plate depth of 30μ, which step was followed by drying with hot air at 90° C.

The heat transfer sheet thus obtained was used for a conventionally used color thermal printer to obtain beautiful printed letters.

EXAMPLE 4

In Example 1, on the ink layer of the heat transfer sheet thus prepared, an ink having the following formulated composition was superposed as coating thereon.

| | |
|---|---|
| Compound of formula (I): 14,21,28,35-tetramethyl-1-sulfonil-pentacontane (molecular weight 840, m.p. 72° C.) | 30 parts |
| Ethylene-ethyl acrylate-maleic acid terpolymer "GB301" (Nitto Unicar, Japan) | 3 |
| Talc "Microace L-1" | 10 |
| Xylene | 57 |
| | 100 |

The transfer sheet had a great effect of preventing ground staining.

EXAMPLE 5

As the compound of the formula (II),

| | |
|---|---|
| Soybean oil fatty acid | 100 parts |
| Trimethylolpropane $\{CH_3CH_2C(CH_2OH)_3\}$ | 60 parts |
| Glycerine $\{CHOH(CH_2OH)_2\}$ | 40 parts |

were mixed to carry out esterification, thereby accomplishing dehydration through the reaction of OH groups of trimethylolpropane and glycerine with COOH groups of soybean fatty acid. Next, solvent fractionation was carried out, followed by molecular distillation, to prepare a compound (IIa). The above reaction product was found to be a yellowish white solid at room temperature and had an ester value of 70 to 90 and a molecular weight of 700 to 800 m.p. 75° C.

Next,

| | |
|---|---|
| Above compound (IIa) | 90 parts |
| Red pigment (C.I. 15850) | 10 parts |

were kneaded in a sand mill heated to 100° C. for 3 hours to obtain a red composition. This composition was applied by a wire bar to 3 g/m$^2$ on a transparent polyester with a thickness of 25 μm placed on a hot plate heated to 100° C.

COMPARATIVE EXAMPLE

In Example 5, in place of the compound (IIa), a polyethylene wax having a melting point of 75° C. was used and kneaded under the same conditions, and the resultant composition was applied in the same amount on the same base sheet according to the same method. When the film (A) obtained in Example 5 and the film (B) obtained in the above Comparative Example were observed similarly with white light, the film (A) was clearly more brilliant in red color as compared with the film (B), and also exhibited superior transparency. This fact suggests that the pigment particles of the compound (IIa) are more finely and uniformly dispersed as compared with those of the polyethylene wax.

EXAMPLE 6

In order to form a heat-resistant protective layer, the following composition (F) was prepared.

| Composition (F): | |
|---|---|
| 50% xylene solution of silicone-modified polyester resin ("KR5203", manufactured by Shin-Etsu Kagaku, K. K., Japan) | 10 parts |
| Fluorocarbon (F-57, manufactured by Accell) | 4 parts |
| Toluene | 25 parts |
| Xylene | 25 parts |

This composition (F) was applied as a coating onto a polyester film of 3.5 μm thickness to form the heat-resistant protective layer to a coating thickness of 1 μm on a dry basis by a gravure printing method and dried at a temperature of 100° C.

The above film coated with the heat-resistant layer was coated with the composition for OP of Example 4 by a roll coater. Drying at 100° C. in hot air for 3 seconds gave a coating weight of 0.7 g/m$^2$. Next, the red composition of Example 5 was dissolved and dispersed in toluene at 65° C. to 40%. The red composition was applied by a gravure roll coater onto the OP layer of the above film coated with the heat resistant layer and the OP layer. The melting point of the OP layer was about 42° C. and no damage was caused when the red composition was applied by gravure coating at 65° C. By hot air drying at 90° C. for 5 seconds, the solid weight of the red composition became 3 g/m$^2$.

The above heat transfer sheet was used for carrying out printing on a paper for an over-head projector (OHP) by means of a thermal printer equipped with a thermal head capable of generating an applied energy of 1 mJ/1 dot. During printing, no running interference due to sticking phenomenon occurred. The image printed on the paper for OHP was protected by the OP layer, and when it was rubbed with another paper for OHP or a paper, there occurred no transfer of color or damage to the image.

EXAMPLE 7

In Example 6, 0.1 part of an antistatic agent Staticide (manufactured by WDK K.K.) was added in the composition (F), and, following otherwise the same procedure as in Example 1, a film was prepared. As contrasted to the surface charged voltage of 10 KV of the film of Example 6, that of this film became 2 KV, whereby dangling during handling could be improved.

EXAMPLE 8

In order to form a heat-resistant protective layer, the following composition (B) was prepared.

| Composition (B): | |
|---|---|
| Vinylidene fluoride-tetrafluoroethylene copolymer (Kynar 7201, manufactured by Penwalt Corporation) | 8 parts |
| Polyester polyol | 40 parts |

-continued

| Composition (B): | |
|---|---|
| (Takerak XU-534 TV; 40% MEK solution; manufactured by Takeda Yakuhin Kogyo, K. K., Japan) | |
| Fluorocarbon (MOLD WIZ F-57, manufactured by Accell) | 5 parts |
| Benzoguanamine resin powder (Epostar S, manufactured by Nippn Shokubai Kagaku Kogyo Co., Ltd., Japan) | 3 parts |
| Lecithin (manufactured by Ajinomoto Co., Inc., Japan) | 1 part |
| MEK | 35 parts |
| Toluene | 45 parts |

An isocyanate (Collonate L; 75% ethyl acetate solution; manufactured by Nippon Polyurethane, Japan) was admixed into the composition (B) in a weight ratio of composition (B) in isocyanate of 14:3 as a coating onto polyester film of 6 μm thickness to a coating thickness of 0.5 μm on a dry basis by a gravure printing method and dried at a temperature of 80° C.

Also, a hot melt binder was prepared as follows.

| | |
|---|---|
| As the compound (I): | |
| 14,21,28,35-tetramethyl-1-hydroxy-pentacontane | 90 parts |
| As the compound (II): | |
| Compound (IIa) of Example 5 | 10 parts |

The above compounds were mixed to provide a binder (I-IIa). The binder (I-IIa) had an acid value of 7.4 an OH value of 50~70 and a saponification value of 20~40, with a melting point of 73° C.

| | |
|---|---|
| Binder (I-IIa) | 45 parts |
| Coloring agent | 5 parts |
| Xylene | 50 parts |

By the use of a yellow pigment (Dainichi Seika 2400), the above formulation was dispersed and kneaded by means of a ball mill at 60° C. for 2 days to provide an ink (Y). Similarly, an ink (M) was prepared by use of a magenta pigment (Carmine 6B), an ink (C) by use of a cyan dye (phthalocyanine blue) and an ink (B1) by use of a black pigment (carbon black), respectively.

By means of a multi-color gravure printing machine, on the back surface of a polyester film having the heat-resistant layer already formed thereon as the base sheet, printing was so carried out that the color was successively varied in the longer direction of the base sheet by the use of the above inks. The coating amount on a dry basis was 3.0 g/m$^2$ for each color.

By the use of the above transfer film, printing was carried out on a plain paper by means of a transfer printer mounted with a thermal head. First, the yellow portion of the transfer film was brought into contact with the paper and transferred thereonto by driving the thermal head with the signal only of the image points of the yellow component of the color image to be transferred. Next, the paper having the yellow portion transferred thereon was returned to the original position, and the image points of the magenta component were transferred from the magenta portion of the transfer film. Subsequently, when the cyan portion and the black portion were similarly transferred, the original color image was found to be reproduced.

EXAMPLE 9

In Example 8, between the base sheet and the transfer ink layer, the composition shown below was applied according to the gravure reverse method to a dry weight of 1 g/m$^2$.

| Matte layer composition: | |
|---|---|
| Polyester resin ("Vylon 200",. manufactured by Toyobo) | 6 parts |
| Vinyl chloride/vinyl acetate copolymer resin ("Vinilite VAGH", manufactured by UCC) | 7 parts |
| Electroconductive carbon ("Ketjen BLACK", manufactured by Lion Akzo K. K.) | 5 parts |
| Methyl ethyl ketone | 30 parts |
| Toluene | 30 parts |

The above composition was mixed with a 50% butyl acetate solution of an isocyanate ("Takenate D-204", manufactured by Takeda Yakuhin Kogyo, Japan) in a ratio of the above composition:isocyanate=20:3 (weight ratio) to provide a matte layer composition.

When the image was formed on a paper in the same manner as in Example 8, the image surface assumed a matte state, whereby it could be seen very easily.

What is claimed is:

1. A heat transfer sheet, comprising a sheet for heat transfer recording which transfers ink on a base sheet onto a recording paper, said ink containing a compound represented by formula (I) shown below as a binder component:

$$C_nH_{2n+1}CH_2Y \qquad (I)$$

wherein n is an integer of 21 to 50, and Y represents OH, $SO_3H$, $C_6H_5$ or COOH, or a Ca, Al or Zn salt thereof.

2. A heat transfer sheet according to claim 1, wherein the compound of the formula (I) is a higher alcohol in which Y=OH, said higher alcohol being formed by oxidation and reduction of a paraffin and having a molecular weight within the range of from 750 to 900.

3. A heat transfer sheet according to claim 1, wherein the compound of the formula (I) is selected from the group consisting of hydroxypentacontane, hydroxyhentriacontane, hydroxytetracontane and derivatives thereof.

4. A heat transfer sheet according to claim 2, wherein the content of the compound of the formula (I) in the ink composition is from 10 to 98% by weight.

5. A heat transfer sheet according to claim 1, wherein a compound of formula (II) shown below is further contained as the binder component:

$$R-\underset{\underset{O}{\|}}{C}-O-CHY-O-\underset{\underset{O}{\|}}{C}-R' \qquad (II)$$

wherein R and R', which may be either identical or different, each represents an alkyl group having 28 to 34 carbon atoms, and Y is the same as defined above.

6. A heat transfer sheet according to claim 5, wherein 10 to 100 parts by weight of the compound of the formula (II) is contained per 10 to 100 parts by weight of the compound of the formula (I) in the binder component.

7. A heat transfer sheet according to claim 5, wherein the compound of the formula (II) is an ester obtained by the reaction between a polyhydric alcohol comprising a mixture of trimethylolpropane and glycerine and soybean oil fatty acid.

8. A heat transfer sheet according to claim 5, wherein said ink comprises a plurality of layers of different colors which have been applied onto the base sheet as separate patches.

9. A heat transfer sheet according to claim 1, wherein said ink comprises a plurality of superposed layers of different colors which have been applied onto the base sheet in laminated state.

10. A heat transfer sheet according to claim 1, wherein an antisticking layer is applied onto the surface of the base sheet on the side where no ink layer has been applied, i.e., the side contacted by the thermal head.

11. A heat transfer sheet according to claim 1, wherein an over printing layer is provided between the base sheet and the ink layer or on the surface of the ink layer.

12. A heat transfer sheet according to claim 10, wherein said antisticking layer contains an antistatic agent.

13. A heat transfer sheet according to claim 1, wherein said ink layer contains an antistatic agent.

14. A heat transfer sheet according to claim 1, wherein a matte layer is interposed between the base sheet and the ink layer.

15. A heat transfer sheet according to claim 1, wherein the base sheet surface to which the ink layer is applied is matte processed.

* * * * *